US006276376B1

(12) United States Patent
Hörmann

(10) Patent No.: US 6,276,376 B1
(45) Date of Patent: Aug. 21, 2001

(54) WASHING MACHINE FOR LAMELLAR BLINDS

(76) Inventor: Wolfgang Hörmann, Goldberger Strasse 20, Zölkow, D-19374 (DE)

( * ) Notice: Subject to any disclaimer, the term of this patent is extended or adjusted under 35 U.S.C. 154(b) by 0 days.

(21) Appl. No.: 09/403,083

(22) PCT Filed: Apr. 9, 1998

(86) PCT No.: PCT/DE98/01014

§ 371 Date: Dec. 3, 1999

§ 102(e) Date: Dec. 3, 1999

(87) PCT Pub. No.: WO98/47421

PCT Pub. Date: Oct. 29, 1998

(30) Foreign Application Priority Data

Apr. 19, 1997 (DE) ..... 297 07 093 U

(51) Int. Cl.[7] ..... B08B 3/02

(52) U.S. Cl. ..... 134/95.3; 134/104.1; 134/198; 134/201; 134/182

(58) Field of Search ..... 134/103.1, 94.1, 134/95.3, 99.1, 198, 201, 182, 183, 104.2, 199

(56) References Cited

U.S. PATENT DOCUMENTS

| | | | | |
|---|---|---|---|---|
| 2,586,620 | * | 2/1952 | De Hart . | |
| 2,624,899 | * | 1/1953 | Smith . | |
| 2,665,698 | * | 1/1954 | Robinson . | |
| 2,682,676 | * | 7/1954 | Franchi . | |
| 2,878,820 | * | 3/1959 | Carr, Jr. . | |
| 3,019,801 | * | 2/1962 | Peterson . | |
| 3,314,819 | * | 4/1967 | Dyer . | |
| 3,434,882 | * | 3/1969 | Carolin . | |
| 3,593,728 | * | 7/1971 | Sauer . | |
| 3,734,108 | * | 5/1973 | Almegard et al. . | |
| 4,897,122 | * | 1/1990 | Schreiber et al. . | |
| 5,021,097 | | 6/1991 | König et al. | 134/25.5 |
| 5,106,426 | | 4/1992 | König et al. | 134/25.1 |
| 5,700,328 | * | 12/1997 | Kawanobe . | |
| 5,826,603 | * | 10/1998 | Mellin . | |
| 5,876,516 | * | 3/1999 | Miller . | |

FOREIGN PATENT DOCUMENTS

| | | | | |
|---|---|---|---|---|
| 3321592 | * | 12/1984 | (DE) . | |
| 3825622 | * | 2/1990 | (DE) . | |
| 295 11 546 U1 | | 7/1995 | (DE) . | |
| 195 28 857 C1 | | 8/1995 | (DE) . | |
| 295 11 546 U1 | | 11/1995 | (DE) | A47L/4/00 |
| 0 352 496 A2 | | 12/1993 | (EP) | A47L/4/00 |
| 1099701 | * | 1/1968 | (GB) . | |
| 11-334456 | * | 12/1999 | (JP) . | |

OTHER PUBLICATIONS

European Patent Application 174,210 Sep. 1995.*

* cited by examiner

*Primary Examiner*—Frankie L. Stinson
(74) *Attorney, Agent, or Firm*—Darby & Darby

(57) ABSTRACT

A washing machine for lamellar blinds includes a moveable wash container operationally connected to a transportable shower head, which is also operationally connected to a catch basin. For easy handling and transport, the outside dimensions of the catch basin (2) are matched to the inside dimensions of the wash container (1). The catch basin (2) is constructed such that it can be inserted into the wash container (1).

8 Claims, 2 Drawing Sheets

WASHING MACHINE FOR LAMELLAR BLINDS

BACKGROUND OF THE INVENTION

1. Field of the Invention

The invention relates to a washing machine for lamellar blinds according to the preamble of claim 1.

Washing machines of this type are used in particular in the service industry for cleaning purposes.

2. Description of the Related Art

Washing machines for cleaning suspended lamellar blinds and vertical lamellar blinds that have been collapsed to a block, are substantially described in EP 352 496 B1 and DE 195 28 857 C1 . The operating principle forming the basis for the solutions disclosed in the two references is to collapse the vertical lamellar blinds which are suspended from a track by pushing them together, to pull a tubular foil over the collapsed lamellar blinds and to suspend the collapsed lamellar blinds in a wash container. A shower head with two rails with jet nozzles is placed on the lamella block, wherein the shower head is connected via a hose to the wash container. The wash container has a pump and associated pipes, connections and fittings to transport the washing solution to the shower head, where the washing solution exits under pressure, runs down the lamellar blind and is again collected in the wash container.

The wash container disclosed in EP 352 496 B1 is placed on a moveable cart. During the washing operation, the wash container is placed on the ground, whereas the wash container is placed on the cart when the washing solution is to be exchanged for a rinsing fluid and when the wash container is moved to a next lamellar blind.

The wash container disclosed in DE 195 28 857 C1, on the other hand, is itself moveable. The washing solution is replaced by a rinsing fluid according to a special method.

The solutions proposed in the two references have an additional catch basin for cleaning those lamellar blinds, which, for example, because of the presence of a window sill, have insufficient space for placing the wash container. The discharged washing solution is therefore received in the catch basin and transferred to the remote wash container by gravity.

The three-piece arrangements disclosed in EP 352 496 B1 makes the operation of the washing machine quite complex.

It places a great burden on the operator to continuously raise and lower the wash container on the cart during the washing operation, which also prolongs the effective washing time.

In addition, all hose connections between the wash container 1 and the catch basin 2 have to be disconnected and then again reconnected before and after the washing operation, respectively, which requires a longer set-up time.

It also places a burden on the operator to handle the additional catch basin during the transport to the washing location and during set-up and disassembly. A particular impediment in the logistics of commercial operations are the many voluminous containers.

The lack of a protection for the switching console and the lack of a cover for the wash container during the transport is also disadvantageous.

DE 195 28 857 C1 already offers certain advantages in this respect, since the device has only two parts which have to be handled, namely the wash container and the catch basin.

The problems associated with the logistics, the lack of a protection for the switching console and the lack of a cover of the wash container, however, remain.

It is therefore an object to provide a washing machine of the aforedescribed type with a compact design.

SUMMARY OF THE INVENTION

The object is solved by the characterizing features of claim 1. Advantageous embodiments of the invention are described in the dependent claims 2 to 7.

The present invention eliminates the disadvantages of the state-of-the-art devices.

The advantages of the invention are apparent, in particular with respect to the logistics, such as transport and storage. The compact design improves the handling characteristics and saves a significant amount of space.

In the collapsed state, the inside of the catch basin 2 advantageously provides sufficient storage space for additional supplies, such as the shower head, the pressure line and the return line and the tubular foil. Fastening devices, such as attachment belts, may also be provided.

BRIEF DESCRIPTION OF THE DRAWINGS

The invention will be described hereinafter with reference to an embodiment.

It is shown in

DETAILED DESCRIPTION OF A PREFERRED EMBODIMENT

Figure 1:
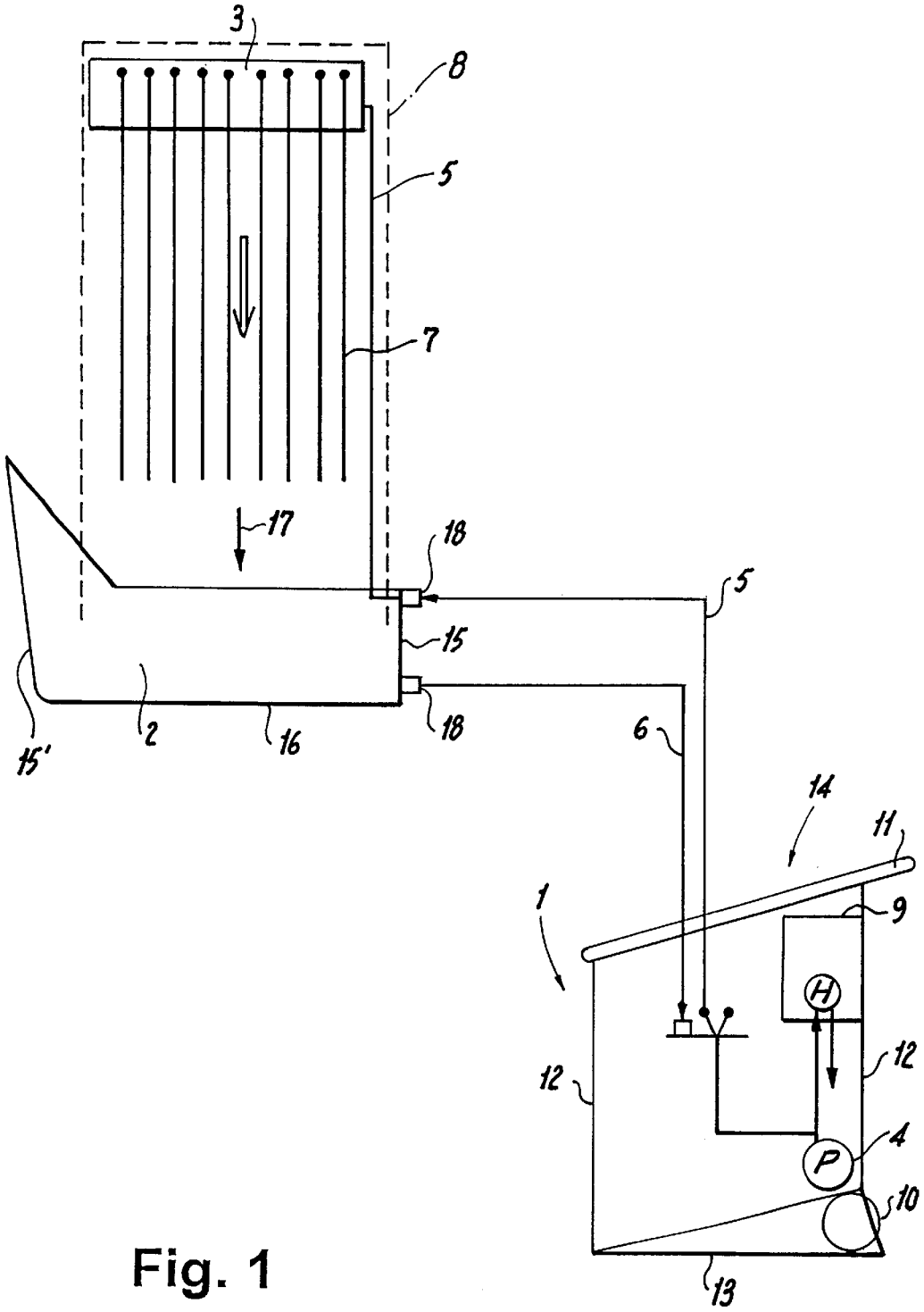
FIG. 1: a schematic diagram of a washing machine with a catch basin.
Figure 2:
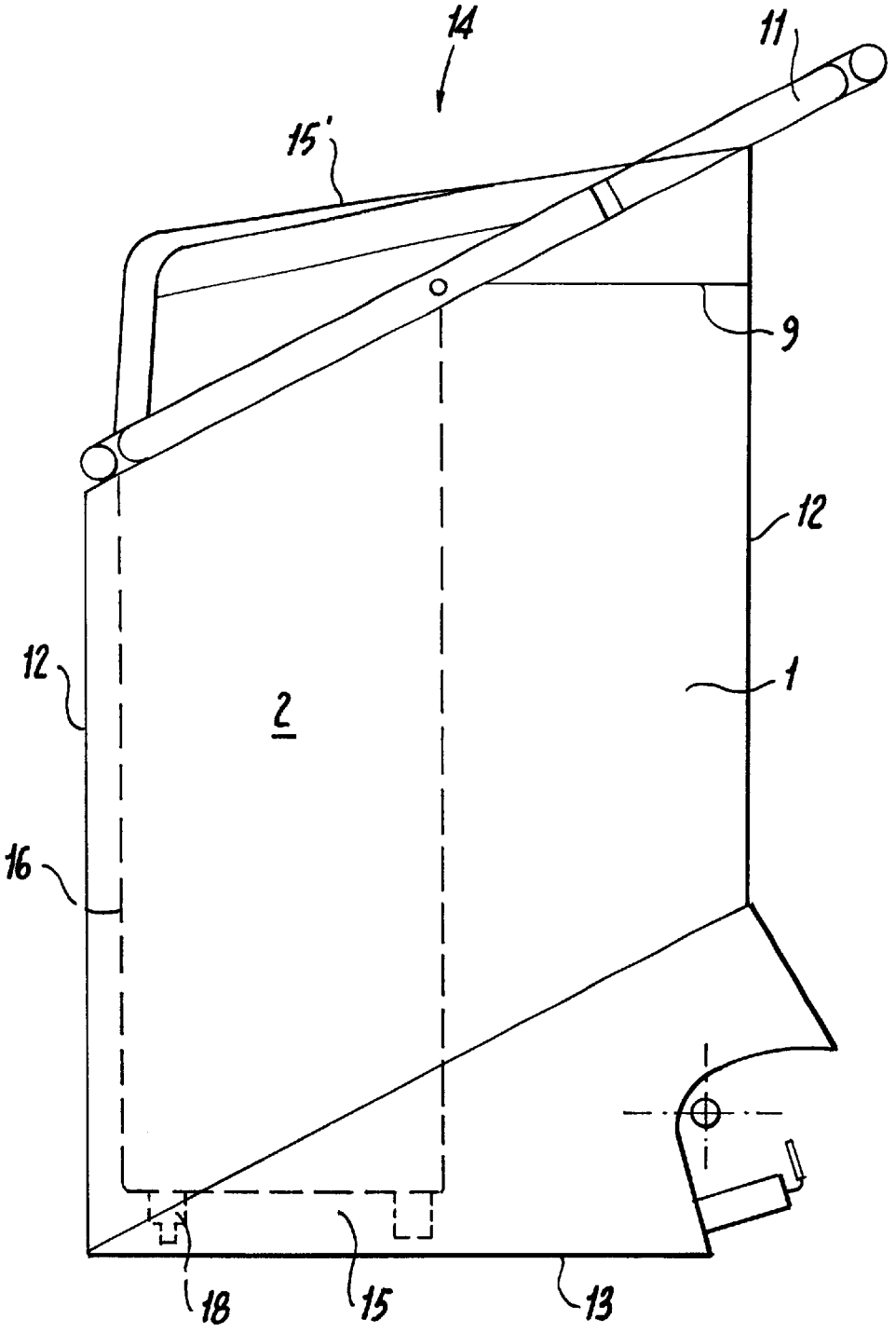
FIG. 2 a side view of the washing machine with inserted catch basin.

Referring to now to FIG. 1, the washing machine includes a wash container 1, a catch basin 2 and a shower head 3. A pump 4, disposed in the wash container 1, is connected via a pressure line 5 to the shower head 3, whereas the return line 6 extends from the catch basin 22 to the wash container 1. The shower head 3 can be inserted in and placed on the lamellar blinds 7 which are collapsed to form a block. A tubular foil 8 is pushed from below over the block of lamellar blinds 7 and closed shut over the shower head so as to surround and seal the shower head 3 and the lamellar blinds 7 water-tight against the outside. The lower end of the tubular foil 8 extends downwardly into the catch basin 2.

Aside from the pump 4 and other valves and connections, a control console 9 for the required operational controls is also located inside the wash container 1.

The wash container 1 is moveable and therefore has wheels 10 and a handle 11.

The wash container 1 has an approximately rectangular cross-section with four side walls 12, a bottom wall 13 and an upper container opening 14.

The catch basin 2 also has an approximately rectangular cross-section with four side walls 15, a bottom wall 16 and an upper basin opening 17. According to the invention, one of the side walls 15' is higher than all the other three side walls 15. The higher side walls 15' may be self-supporting or may be supported on both sides by a rising portion of the two adjacent side walls 15.

The outside dimensions of the catch basin 2 are specially matched to the inside dimensions of the wash container 1, so that the catch basin 2 can be inserted inside the wash container 1 for transport.

In the illustrated embodiment, one of the dimensions of the widths of the catch basin 2 corresponds to one of the dimensions of the widths of the container 1, whereas one of the other widths dimensions of the catch basin 2 corresponds to the height of the wash container 1, and the height of one of the side walls 15' of the catch basin 2 corresponds to the other widths dimension of the wash container 1. In addition, the height of the other side walls 15 of the catch basin 2 is smaller than the unobstructed width of the wash container 1 at the height of the operating console 9.

Preferably, fittings 18 for the pressure line 5 and the return line 6, respectively, are arranged on the side wall 15 which is located opposite the higher side wall 15'.

When arranged for transport, the catch basin 2 is inserted in the wash container 1 so that the side wall 15 opposite from the raised side wall 15', or alternatively at least one of the fittings 18 of the catch basin 2, contacts the bottom wall 13 of the wash container 1. The higher side wall 15' contacts the upper rim of the wash container 1 and covers the entire container opening 14 and thereby also the operating console 9 located underneath.

Even with this arrangement, the pressure line 5 and the return line 6 may remain connected to the fittings 18 of the catch basin 2.

To place the washing machine in operation, it is only necessary to lift the catch basin 2 with the connected pressure line 5 and the return line 6 out of the wash container 1 and to place the catch basin 2 under the lamella block.

What is claimed is:

1. A washing machine for lamellar blinds, comprising (a) a wash container (1) including a handle (1 ), a plurality of wheels (10), a pump (4), fittings and an operating console (9);

(b) a shower head (3) surrounded by a tubular foil (8);

(c) a catch basin positioned underneath the lamellar blinds (7);

the wash container (1) being connected via a pressure line (5) with the shower head (3) and via a return line (6) with the catch basin (2), and wherein the outside dimensions of the catch basin (2) and the inside dimensions of the wash container (1) are designed such that the catch basin (2) fits inside the wash container (1).

2. The washing machine for lamellar blinds according to claim 1, wherein the catch basin (2) comprises a first side wall (15') which is higher than a second side walls (15), and wherein the first side wall (15') is formed as a cover for the wash container (2).

3. The washing machine for lamellar blinds according to claim 2, wherein the first side wall (15') includes a raised portion having two sides and the second side walls (15) includes a raised portion and two sides and wherein the raised portion is supported on each side by the raised portion of the two adjacent side walls (15).

4. The washing machine for lamellar blinds according to claim 3, wherein the catch basin (2) between the second side wall (15') and the opposite first side wall (15) has a widths dimension which corresponds to the height of the wash container (1).

5. The washing machine for lamellar blinds according to claim 3, wherein the catch basin (2) between the second side wall (15') and the opposite first side wall (15) has a widths dimension so that at one of the fittings (18) is able to contact the bottom wall (13) of the wash container (1).

6. The washing machine for lamellar blinds according to claim 5, wherein the wash container 1 includes a handle (11) and wherein the wash container (1) comprised an opening (14) having a circumferential edge which slopes extending from the handle (11) and wherein the second side wall (15') of a catch basin (2) is oriented essentially perpendicular to the bottom wall (16) of the catch basin (2).

7. The washing machine for lamellar blinds according to claim 6, wherein the catch basin (2) is formed as a receptacle for additional supplies and comprises at least one attachment device.

8. The washing machine for lamellar blinds according to claim 6, wherein the wash container (1) comprises at least one wheel (10).

* * * * *